US009200623B2

(12) United States Patent
Romain

(10) Patent No.: US 9,200,623 B2
(45) Date of Patent: Dec. 1, 2015

(54) METHOD, DEVICE AND MEANS FOR DRIVING A RECIPROCATING LINEAR MOTION DOUBLE ACTING PUMP

(75) Inventor: Mathieu Romain, Coye la Foret (FR)

(73) Assignee: EXEL INDUSTRIES, Epernay (FR)

( * ) Notice: Subject to any disclaimer, the term of this patent is extended or adjusted under 35 U.S.C. 154(b) by 972 days.

(21) Appl. No.: 13/242,884

(22) Filed: Sep. 23, 2011

(65) Prior Publication Data

US 2012/0076666 A1 Mar. 29, 2012

(30) Foreign Application Priority Data

Sep. 29, 2010 (FR) ..... 10 57862

(51) Int. Cl.

| | |
|---|---|
| ***F04B 49/06*** | (2006.01) |
| ***F04B 49/08*** | (2006.01) |
| ***F04B 5/02*** | (2006.01) |
| ***F04B 15/02*** | (2006.01) |
| ***F04B 49/20*** | (2006.01) |

(52) U.S. Cl.

CPC . *F04B 5/02* (2013.01); *F04B 15/02* (2013.01); *F04B 49/06* (2013.01); *F04B 49/20* (2013.01); *F04B 2201/1201* (2013.01); *F04B 2201/1202* (2013.01); *F04B 2201/1203* (2013.01); *F04B 2203/0207* (2013.01); *F04B 2203/0209* (2013.01); *F04B 2205/04* (2013.01)

(58) Field of Classification Search

CPC ..... F04B 11/00; F04B 11/0041; F04B 49/00; F04B 49/065; F04B 2201/0203; F04B 2201/1201; F04B 2203/02; F04B 2203/0207; F04B 2205/04; F04B 2205/05

USPC ..... 417/22, 42, 44.2, 53, 415–417

See application file for complete search history.

(56) References Cited

U.S. PATENT DOCUMENTS

| | | | | |
|---|---|---|---|---|
| 6,074,170 | A * | 6/2000 | Bert et al. | 417/44.2 |
| 2006/0153700 | A1 | 7/2006 | Benckert et al. | |

FOREIGN PATENT DOCUMENTS

| | | | |
|---|---|---|---|
| DE | 197 36 337 | A1 | 2/1999 |
| DE | 100 20 453 | A1 | 12/2000 |
| WO | 02/46612 | A1 | 6/2002 |

OTHER PUBLICATIONS

French Search Report, dated Aug. 3, 2011, from corresponding French application.

* cited by examiner

*Primary Examiner* — Peter J Bertheaud

(74) *Attorney, Agent, or Firm* — Young & Thompson

(57) ABSTRACT

A method for controlling a drive unit mechanically connected to a reciprocating linear-motion double-acting pump includes the use of speed-regulating control during the phase in which the piston is moving in just one direction, ascent (109) or descent (102), and the use of torque-regulating control immediately after the reversal (107, 114) of the direction of travel. The method is applicable to a control device and to a drive unit mechanically connected to a reciprocating linear-motion double-acting pump.

7 Claims, 3 Drawing Sheets

METHOD, DEVICE AND MEANS FOR DRIVING A RECIPROCATING LINEAR MOTION DOUBLE ACTING PUMP

The invention relates to a method for controlling a drive means mechanically connected to a reciprocating linear-motion double-acting pump.

The invention also relates to a device for controlling a drive means mechanically connected to a reciprocating linear-motion double-acting pump.

The invention finally relates to a drive means connected mechanically to a reciprocating linear-motion double-acting pump.

BACKGROUND OF THE INVENTION

Reciprocating linear-motion pumps for liquid or pasty products and which are mechanically connected to electric motor control systems are known. Such linear pumps are driven with a predetermined stroke, after which the direction of travel is reversed, and the pump is driven over the same predetermined stroke in the opposite direction. The movement of the pump piston can be reversed from a direction of expelling the component to a direction of drawing in and expelling the component, and vice versa. The pump circuit comprises an intake valve and a delivery valve both associated with the pump.

The reversal of the direction of travel of the pump causes a sudden drop in pressure followed immediately by a pressure spike in the flow of the liquid or pasty product delivered by the pump. When the direction of travel of the pump is reversed, the valves that hold back the liquid or pasty product in a reciprocating-motion pump may also contribute to the pressure variations that occur during reversal.

Electric-motor-powered drive systems for linear reciprocating-motion pumps and comprising electrical controls for regulating the speed at which the motor is driven according to the pressure or delivery of liquid or pasty product, with electric cut-off means for disconnecting the supply of power to the motor when pressure lock conditions are encountered, are known.

The reversal effect is, however, amplified by the inertia of an electric-motor-drive device connected mechanically to a reciprocating linear-motion double-acting pump, generating a pressure drop which is longer and a pressure spike that is higher during reversal.

SUMMARY OF THE INVENTION

It is a first object of the invention to improve on the known art by proposing a new method for controlling a drive means mechanically connected to a reciprocating linear-motion double-acting pump.

It is a second object of the invention to propose a new control device for a drive means connected mechanically to a reciprocating linear-motion double-acting pump.

It is a third object of the invention to propose a new drive means mechanically connected to a reciprocating linear-motion double-acting pump.

A subject of the invention is a method of controlling a drive means mechanically connected to a reciprocating linear-motion double-acting pump, comprising the following steps:

a) using a speed-regulating control during the ascent or descent phases of the piston;

b) using a torque-regulating control immediately after the reversal of direction of travel, so as to obtain a flow rate of pumped liquid or pasty product that is substantially constant, while at the same time reducing the pressure pulses during pump operation.

According to other alternative features of the invention:

- The torque is recorded during the ascent or descent phases of the piston in order from this to deduce the torque setpoint for the torque-regulating control following a next reversal phase.
- The movement of the drive means is accelerated after the direction of travel has been reversed.
- The control switches from torque regulation to speed regulation when a physical parameter exceeds a value representative of a torque value.
- The physical parameter representative of a torque value may be a measured pressure of the liquid or pasty product delivered by the reciprocating linear-motion double-acting pump.

Another subject of the invention is a device for controlling a drive means mechanically connected to a reciprocating linear-motion double-acting pump, comprising means for using speed-regulating control during ascent or descent phases of the piston, means for using torque-regulating control immediately after the reversal of the direction of travel, means for measuring a physical parameter representative of a torque value and/or for recording the torque during the piston ascent or descent phases, and means for accelerating the drive means after the direction of travel has been reversed.

According to one advantageous feature of the invention, the means for measuring a physical parameter representative of a torque value comprise a sensor of the pressure of the liquid or pasty product delivered by the reciprocating linear-motion double-acting pump.

A final subject of the invention is a drive means connected mechanically to a reciprocating linear-motion double-acting pump and comprising a geared motor unit with encoder connected to a mechanical transmission means coupled to a reciprocating linear-motion double-acting pump, and a pressure sensor sensing the pressure of the liquid or pasty product delivered by the reciprocating linear-motion double-acting pump.

According to other alternative features of the invention:

- the mechanical transmission means comprise a recirculating-roller screw or a recirculating-ball screw that converts the circular movement of the geared motor unit into a linear movement transmitted to the reciprocating linear-motion double-acting pump.
- the drive means comprises a controller controlling the rotation of the motor in one direction or the other according to the position of the motor as indicated by the encoder, and providing speed regulation during the phases of movement in just one direction and torque regulation immediately after the reversal of direction, and a means for storing the operating torque of the motor during the phases of travel in just one direction.

BRIEF DESCRIPTION OF THE DRAWINGS

The invention will be better understood by virtue of the following description, given by way of nonlimiting example with reference to the attached drawings in which.

DETAILED DESCRIPTION OF THE PREFERRED EMBODIMENTS

Figure 1:
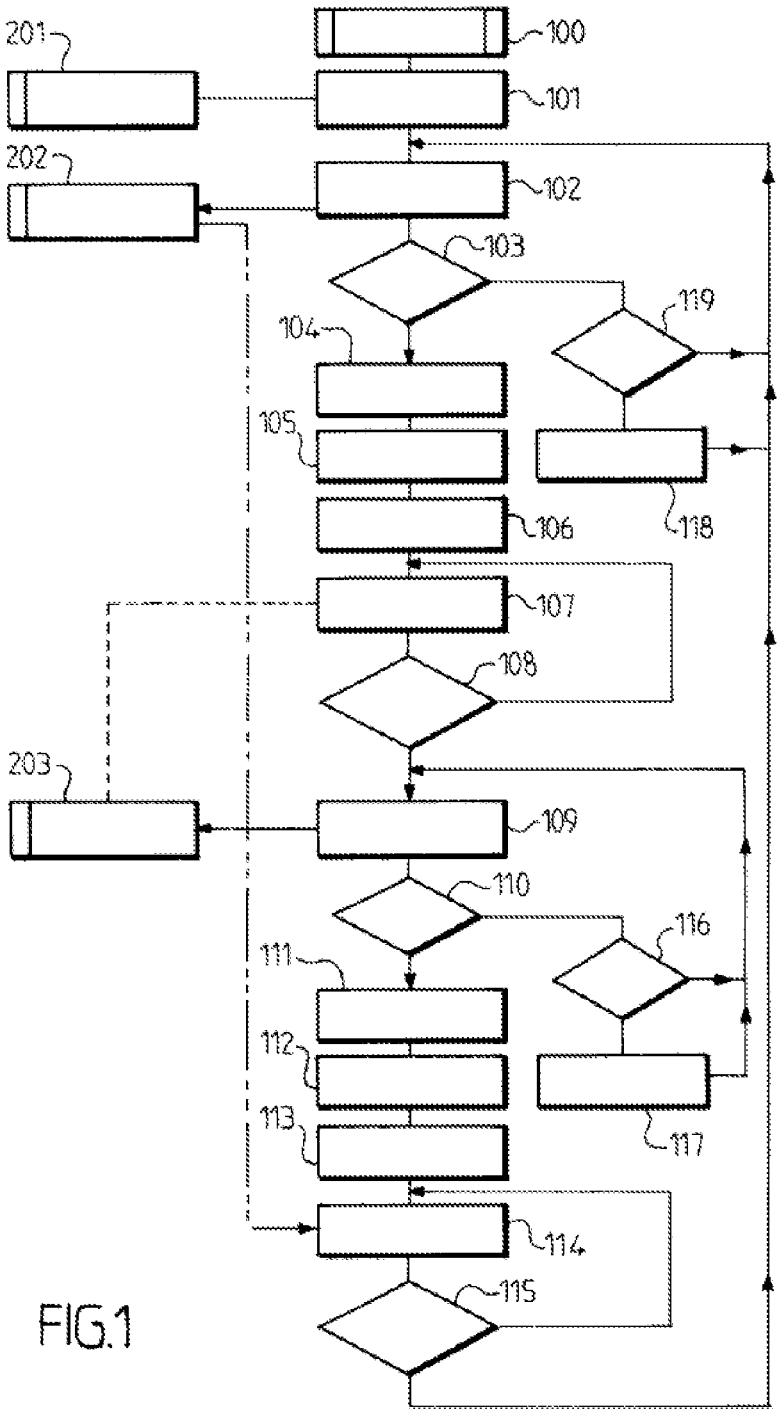
FIG. 1 is a schematic flow diagram of a control method according to the invention.

With reference to FIG. 1, a method for controlling a drive means mechanically connected to a reciprocating linear-motion double-acting pump comprises steps 100 to 119 and 201 to 203.

In step 100, the method starts with a step of beginning an operating cycle.

In step 101, the method continues with a step 102 of acquiring a delivery setpoint value input by an operator using a man/machine interface and which is converted into an absolute speed setpoint for speed-regulating an electric drive motor during the phases of travel in just one direction.

In step 102, the rotation of the electric motor occurs with speed regulation in just one direction, being converted into a linear movement, for example into a descent of the piston of a double-acting pump mechanically connected to the electric motor.

During this step 102, the torque of the electric motor is recorded in a parallel step 202 in a man/machine interface or some other memory storage means.

In step 103, a test is carried out to detect whether a bottom position or an end-of-stroke position is approaching.

If no change in delivery is to be carried out, the method loops back to step 102 after checking, in step 118, that the delivery or speed setpoint is being maintained.

If a change in delivery or speed setpoint is detected in step 118, this new delivery or speed setpoint is acquired and a corresponding change to the torque is made in step 119 by a controller that controls the electric motor. The method then loops back to step 102, using these new setpoint and torque values.

If a bottom or end-of-stroke position is detected in step 103, the method moves on to step 104, a step of decelerating the rotational movement of the electric motor, and then to step 105 which is a reversal in the direction of rotation of the electric motor corresponding to a reversal in the direction of linear travel of the reciprocating linear-motion double-acting pump.

In step 106, immediately after the reversal in the direction of travel of the pump and direction of rotation of the electric motor, an acceleration is brought about by regulating the torque to compensate for the drop in pressure of the liquid or pasty product delivered which drop in pressure is caused by the reversal of direction. This torque regulation upon reversal thus makes it possible to obtain a delivery that is constant and makes it possible to effect better recompression, for example during the upstroke of the piston of the double-acting pump mechanically connected to the electric motor.

The torque regulation is carried out in a closed loop advantageously using as its feedback parameter the pressure of the liquid or pasty product delivered, because a correlation between the motor torque and the pressure of the liquid or pasty product delivered allows the pressure of the liquid or pasty product delivered to be used as the physical parameter representative of motor torque.

Thanks to this correlation, it is possible to simulate or replace continuous torque measurement with continuous measurement of the pressure of the liquid or pasty product delivered during the phase of travel in just one direction.

Use is made of the recorded values of motor torque or of pressure of the liquid or pasty product delivered during a step 203 of travel in just one direction in the preceding cycle, for example during the upstroke of the piston of the double-acting pump mechanically connected to the electric motor, by way of setpoint value for regulating the torque in step 107.

In step 108, when the pressure at the pump outlet becomes equal to or higher than the pressure measured during the movement in just one direction in the previous step, or when the motor torque exceeds the torque measured in the movement in just one direction in a step 203 of movement in just one direction in the previous cycle, for example in the upstroke, the method moves on to step 109 and switches to speed regulation.

If this value is not reached, the step 108 loops back to step 107 until the corresponding value or values is or are reached.

In step 109, the pump is moving in just one direction of travel, for example in an upstroke, until a top or end-of-stroke position is detected in step 110.

As long as this top or end-of-travel position is not detected in step 110, the method loops back to step 109, via a test phase 116 which tests for a change in setpoint value for the delivery of liquid or pasty product, and possibly a step 117 of acquiring a new setpoint value converted into a motor speed with corresponding change to torque.

When this top or end-of-stroke position is detected in step 110, the method continues to step 111 of decelerating and stopping the motor.

The method then continues on to step 112 with a reversal in direction, passing immediately following the reversal into regulation of the torque of the motor and to step 113 which is an acceleration to compensate for the drop in pressure in motor torque regulation.

In step 114, torque regulation is performed using the setpoint value recorded during the movement in just one direction during a previous movement step 202 of the previous cycle in just one direction, for example in the downstroke, it being possible for this setpoint value to be a direct motor torque value or a motor torque value obtained by converting a representative physical parameter such as the pressure of liquid or pasty product delivered by the pump.

A test is carried out in step 115 to detect whether the motor torque value exceeds the value recorded during a previous step 202 of travel in just one direction in the previous cycle, for example in the downstroke.

If the test outcome is negative, the method loops back to step 114.

If the test outcome is positive, the method loops back to step 102, to begin a new cycle.

The upstroke and downstroke torques, or values of representative parameters thereof, for example pressure of the liquid or pasty product delivered or equivalent, recorded in steps 202 and 203, are recorded respectively during speed-regulating controls in just one direction of travel described in the downstroke 102 and upstroke 109 steps.

The recording steps 202 and 203 allow the upstroke torque or downstroke torque values to be stored, while at the same time checking whether their variations from one cycle to another are abnormal.

Advantageously, step 201 is carried out by the operator and steps 202 and 203, which the operator can consult, are run on a man-machine interface that forms part of a device according to the invention for implementing a method according to the invention.

The cycle representative of a method according to the invention can be stopped at any time upon action by the operator. The speed regulations take effect as soon as the operator inputs a delivery setpoint via the man-machine interface, which is then converted into an absolute speed setpoint in a step 101.

The accelerations and decelerations can be adjusted within certain safety limits by the operator directly on the man-machine interface.

Using the invention, it is possible to reduce the pressure pulsation caused by the reversal in direction by using just one pressure sensor so that the motor torque can be altered by performing an acceleration and a deceleration directly immediately after the reversal in direction in order to compensate for pressure pulsation and obtain a practically constant delivery of liquid or pasty product.

The direct correlation between motor torque and measured pressure means that it is possible to obtain a constant delivery of product for a wide range of products and delivery rates.

The invention thus makes it possible to obtain a "self adapting" method that can adapt to suit changes of substance, viscosity, temperature and changes of pace, frequency, delivery and other physical or mechanical parameters.

Figure 2:
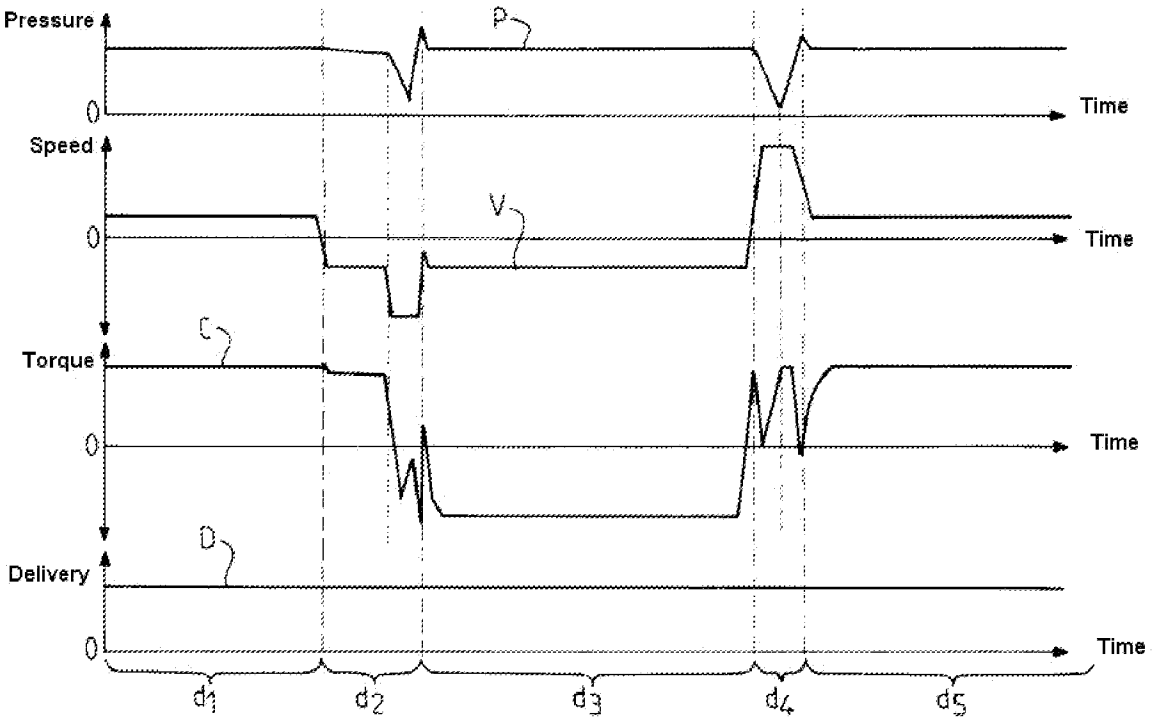
FIG. 2 is a schematic timing diagram corresponding to the steps of the control method according to the invention described with reference to FIG. 1.

In FIG. 2, a timing diagram for the implementation of the method according to the invention described with reference to FIG. 1 comprises five curves showing the evolution of various measurements as a function of time:

the pressure P of the liquid or pasty product, the speed V of linear movement of the pump, the torque C of the drive motor and the delivery D of the liquid or pasty product delivered by the reciprocating linear-motion double-acting pump driven using the control method according to the invention.

The timing diagram corresponds to a cycle beginning with a time interval $d_1$, continuing with a time interval $d_2$, then a time interval $d_3$, then a time interval $d_4$, and finally a time interval $d_5$ that corresponds to the start of the time interval $d_1$ of a following cycle.

The time interval $d_1$ corresponds to the delivery of the product in the downstroke direction and to operating steps 102 and 103, during which the drive motor is controlled with speed regulation.

The time interval $d_2$ corresponds to a torque-regulating control and to steps 106 and 107 of the method described with reference to FIG. 1.

The time interval $d_3$ corresponds to movement in the opposite direction, upstroke, that is to say to the filling and discharging of liquid or pasty product and to steps 108 and 109 that correspond to speed-regulating control.

Time interval $d_4$ corresponds to a deceleration and stopping of the motor, to a reversal of direction, and to a torque-regulating control during steps 111 to 114 of the method described with reference to FIG. 1.

Time interval $d_5$ corresponds to the operating steps 102 and 103 of a following cycle of the method described with reference to FIG. 1.

Thanks to the invention, the variations in drive motor torque are able to compensate for the pressure pulsation caused by the reversal in direction of travel of the double-acting pump and thus yield a delivery that remains practically constant, any negligible variations in which could not be perceived during the tests carried out.

The use of the pressure of the liquid or pasty product delivered by way of physical parameter representative of a torque value is particularly advantageous in simplifying the control devices according to the invention and in allowing real-time continuous control of the liquid or pasty product delivered by the reciprocating linear-motion double-acting pump driven by the drive means controlled by virtue of the invention.

A single pressure sensor for sensing the pressure of the liquid or pasty product delivered by the pump provides a permanent check on the correlation between the torque of the electric motor and the value of the pressure of the liquid or pasty product delivered.

Figure 3:
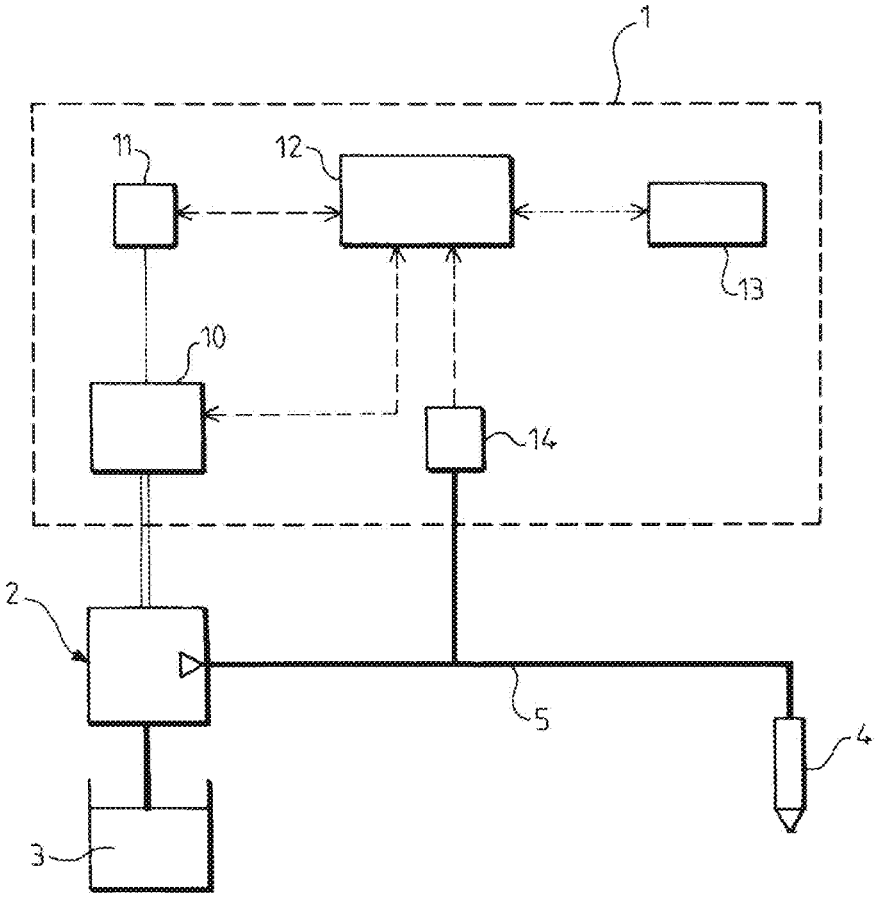
FIG. 3 is a schematic diagram depicting a drive means according to the invention.

In FIG. 3, a functional diagram of a device according to the invention comprises a drive means included within a device schematically depicted in the form of the box (1) drawn in broken line, a pump (2) connected to a tank (3) of product by a suitable line and an extrusion gun (4) connected by a line (5) to the pump (2).

The pump (2) is mechanically driven by a motor or geared motor unit (10), by means of a recirculating-ball screw, a recirculating-roller screw or any other transmission means capable of converting a rotary movement into a linear movement.

The motor or geared motor unit (10) preferably incorporates an encoder (11) which at every instant defines the position of the rotor of the electric motor and thus makes it possible to program operating cycles in one direction, in another direction, or reversals in direction or alternatively of stopping the operation of the electric motor and therefore the reciprocating linear-motion double-acting pump (2).

The encoder (11) sends a controller (12) data relating to the motor (10) so that the operation thereof can be controlled throughout all the steps of a method according to the invention.

The controller (12) is connected to a man-machine interface (13) used for assigning commands to start and stop the operating cycles, to transmit setpoints and parameters defined by an operator and to record or store data relating to the operation of the motor, particularly to record the torque of the electric motor (10) during cycle operations.

To do this, the electric motor (10) is preferably connected to the controller (12) so as to transmit the data relating to the speed, torque and current strength characteristics and other motor operation variables.

A pressure sensor (14) that senses the pressure of the liquid or pasty product delivered by the pump (2) is advantageously connected to the controller (12) in order permanently to apply the correlation between the torque of the electric motor (10) and the value of the pressure of the liquid or pasty product delivered.

When the electric motor or geared motor unit (10) is turning a mechanical transmission means such as a recirculating-ball or recirculating-roller screw, the piston of the pump (2) moves in a linear motion produced by the mechanical transmission means, to pump the liquid or pasty product from the tank (3) to the extrusion gun (4).

When the liquid or pasty product is being pumped, the operator can input and permanently monitor on the screen of the man-machine interface (13) the commands for starting and stopping the operating cycles, the setpoints and predefined parameters or parameters incorporated into the operating cycles, while at the same time checking that the motor is operating correctly and viewing the type of control: speed regulation or torque regulation, that the controller (12) is using at that given moment in time.

This controller (12) effects the there-and-back cycle of the piston of the double-acting pump according to the rotational movements of the motor. The controller (12) is programmed to use speed regulation during the phases of linear movement in just one direction and to use torque regulation immediately after the reversals in direction of rotation.

The controller (12) automatically adapts the torque needed in order to obtain a constant delivery of delivered liquid or pasty product. Inputs and outputs of known type ensure the continuity of the control, monitor the operation of the motor and perform safety functions by limiting the operation of the motor to an authorized range of parameters.

The invention, which has been described with reference to one particular embodiment, is not in any way restricted thereto but on the other hand covers any modification in form and any alternative form of embodiment that falls within the scope and spirit of the invention.

In particular, the controller (12) can be replaced by a simplified controller capable of performing speed regulation and torque regulation using by way of feedback parameter only the pressure of the liquid or pasty product delivered, this pressure being measured by just one pressure sensor (14).

Thanks to the invention, the closed loop control used to regulate the torque is actually considerably improved by using the pressure of the liquid or pasty product by way of the feedback parameter.

The precision with which the pressure of the liquid or pasty product can be measured is actually more reliable than the precision with which the motor torque can be measured and provides a parameter representative of the motor torque, irrespective of the substance to be delivered by the pump, the viscosity or temperature thereof or other physical parameters thereof. The pressure used by way of feedback parameter thus makes it possible by virtue of the invention to obtain self adaptation of the operation with a view to guaranteeing that the liquid or pasty product delivered is delivered at a constant mean delivery rate.

The invention claimed is:

1. A method of controlling a drive means mechanically connected to a reciprocating linear motion double acting pump (2), comprising:

regulating control of the drive means using a speed measurement during phases of operation of the pump during which a piston of the pump is moving in just one direction, ascent (109) or descent (102); and regulating control of the drive means using a torque setpoint value immediately after a reversal (107, 114) of direction of travel of the piston, so as to obtain a flow rate of liquid or pasty product pumped by the reciprocating linear motion double acting pump that is substantially constant, while at the same time reducing pressure pulses during pump operation.

2. The control method according to claim 1, wherein torque is recorded during phases of operation during which the piston is moving in just one direction, ascent or descent, and determining therefrom the torque setpoint value for regulating control of a next reversal phase of operation of the pump.

3. The control method according to claim 2, wherein movement of the drive means is accelerated after the direction of travel of the piston has been reversed, and wherein regulation control is performed using the torque setpoint value recorded during the movement in just one direction, during a previous movement step of a previous cycle of the pump.

4. The control method according to claim 1, wherein control switches from torque regulation to speed regulation when a physical parameter exceeds a value representative of a torque value.

5. The control method according to claim 4, wherein the physical parameter representative of the torque setpoint value is a measured pressure of the liquid or pasty product pumped by the reciprocating linear motion double acting pump.

6. A device for controlling a drive means mechanically connected to a reciprocating linear-motion double acting pump (2), comprising:

means (12) for regulating control of the drive means using a speed measurement during phases of operation of the pump during which a piston of the pump is moving in just one direction, ascent or descent;

means for regulating control of the drive means using a torque value immediately after a reversal of a direction of travel of the piston;

means (14) for measuring a physical parameter representative of the torque value and/or for recording the torque value during piston ascent or descent phases; and means (10, 11) for accelerating the drive means after the direction of travel of the piston has been reversed.

7. The control device according to claim 6, wherein the means for measuring a physical parameter representative of the torque value comprise a sensor (14) of a pressure of a liquid or pasty product delivered by the reciprocating linear motion double acting pump.

* * * * *